US006645018B2

(12) United States Patent
Ishigaki

(10) Patent No.: US 6,645,018 B2
(45) Date of Patent: Nov. 11, 2003

(54) BOAT PROPULSION DEVICE

(75) Inventor: Eiichi Ishigaki, Kagawa (JP)

(73) Assignee: Ishigaki Company Limited, Tokyo (JP)

( * ) Notice: Subject to any disclaimer, the term of this patent is extended or adjusted under 35 U.S.C. 154(b) by 0 days.

(21) Appl. No.: 10/148,192

(22) PCT Filed: Oct. 5, 2001

(86) PCT No.: PCT/JP01/08829

§ 371 (c)(1),
(2), (4) Date: Jun. 6, 2002

(87) PCT Pub. No.: WO02/30741

PCT Pub. Date: Apr. 18, 2002

(65) Prior Publication Data

US 2002/0182947 A1 Dec. 5, 2002

(30) Foreign Application Priority Data

Oct. 6, 2000 (JP) ..... 2000-307264

(51) Int. Cl.[7] ..... B63H 11/107; B63H 11/117

(52) U.S. Cl. ..... 440/43; 440/40; 440/46; 440/47

(58) Field of Search ..... 114/151; 440/38, 440/40–43, 46, 47, 68

(56) References Cited

U.S. PATENT DOCUMENTS

| | | | | | |
|---|---|---|---|---|---|
| 3,116,602 | A | * | 1/1964 | Dahle | 440/43 |
| 3,387,583 | A | * | 6/1968 | Kuether | 440/46 |
| 3,531,214 | A | * | 9/1970 | Abramson | 415/68 |
| 3,561,392 | A | * | 2/1971 | Baez | 440/43 |
| 3,677,215 | A | * | 7/1972 | Moss | 440/43 |
| 4,023,353 | A | | 5/1977 | Hall | |
| 5,480,330 | A | | 1/1996 | Brown | |
| 5,618,213 | A | | 4/1997 | Nanami | |
| 5,634,831 | A | | 6/1997 | Davies et al. | |
| 6,022,250 | A | | 2/2000 | Futaki et al. | |
| 6,033,272 | A | * | 3/2000 | Whiteside | 440/46 |

FOREIGN PATENT DOCUMENTS

| | | | | |
|---|---|---|---|---|
| JP | 52-91294 | | 8/1977 | |
| JP | 55127295 | | 10/1980 | |
| JP | 1-122797 | * | 5/1989 | 440/47 |
| JP | 4-8694 | | 1/1992 | |
| JP | 4-133894 | | 5/1992 | |
| JP | 5-105190 | | 4/1993 | |
| JP | 8-40374 | | 2/1996 | |
| JP | 8-113193 | | 5/1996 | |
| JP | 11124090 | | 5/1999 | |
| SU | 1092098 | * | 5/1984 | 440/47 |
| WO | 9828185 | | 7/1998 | |
| WO | 98/28185 | | 7/1998 | |

OTHER PUBLICATIONS

English Language Abstract for JP Appln. No. 55–127295.
English Language Abstract of JP 11–124090.
English Language Abstract of JP 5–105190.
English Language Abstract of JP 8–40374.
English Language Abstract of JP 4–8694.
English Language Abstract of WO 98/28185.
English Language Abstract of JP 55–127295.
English Language Abstract of JP 8–113193.
English Language Abstract of JP 4–133894.
English Language Abstract of JP 52–91294.

* cited by examiner

*Primary Examiner*—Sherman Basinger
(74) *Attorney, Agent, or Firm*—Greenblum & Bernstein, P.L.C.

(57) ABSTRACT

A vessel propulsion system having a suction casing (4) configured with a suction inlet (4*a*) opening at a vessel bottom (1*b*), a suction flow path (4*b*) inclined to rearwardly ascend from the suction inlet (4*a*), and an impeller chamber (4*c*) formed horizontal, and disposed at a bottom of a stern, a delivery casing (10) connected to the suction casing (4) and submerged under a draft of the stern, and a set of forward and reverse rotatable axial flow blades (8) disposed in the impeller chamber (4*c*) of the suction casing (4).

8 Claims, 8 Drawing Sheets

V
Pr4
1
1a
1b
1c
60
61
62
62a
62b
63
64
65
66
67
68
69
71
72
73
74
75
76
80
81
VIIC

BOAT PROPULSION DEVICE

TECHNICAL FIELD

This invention relates to a vessel propulsion system, and more particularly, to a propulsion system for vessels of a type utilizing the reaction force of discharged water jets for forward or backward travel.

BACKGROUND ART

A water jet propulsion system without protrusions such as a propeller and helm at the vessel bottom can be free from entanglement of string-like drifting matters, allowing the vessel to travel on shallow water.

A conventional water jet propulsion system draws water by suction from a suction casing opening at the hull bottom, guiding drawn water to a pump casing, pressurizing with an impeller, and discharges pressurized water rearward as flux of water jets from a delivery casing opening at the stern at a level above the draft, making use of the reaction force to propel the vessel forward.

In particular, a water jet propulsion system disclosed in Japanese Patent Application Laying-Open Publication No. Hei 11-124090 is adapted by a deflector for changing the discharge direction of water jets to turn the course of travel, and by a reverser for reversing water jets to propel the vessel rearward.

The conventional water jet propulsion system, which allows the vessel to travel backward by reversing water jets discharged behind the stern toward the bow, has a great power loss, and gives a wide range of turn to the vessel coming alongside or leaving a pier, with the propelling force to be weak upon reversal of water jets.

Japanese Patent Application Laying-Open Publication No. Hei-5-105190 discloses a counter-rotating double-impeller type water jet propulsion system including a combination of a front impeller for generating swirling streams and a rear impeller for rectifying them into straight streams to convert energy of rotation into thrust forces, to have an increased propelling force.

This invention aims at provision of a vessel propulsion system which employs the reaction of water jet discharge to provide a vessel propelling force, and which has a minimized energy loss upon switch between forward and rearward movements, allowing for the vessel to come alongside or leave a pier within a narrowed range.

DISCLOSURE OF THE INVENTION

An aspect of the invention is a vessel propulsion system, which comprises a vessel propulsion system comprising a suction casing configured with a suction inlet opening at a vessel bottom, a suction flow path inclined to rearwardly ascend from the suction inlet, and an impeller chamber formed horizontal, and disposed at a bottom part of a stern, a delivery casing connected to the suction casing and submerged under a draft of the stern, and a set of forward and reverse rotatable axial flow blades disposed in the impeller chamber of the suction casing.

According to this aspect of the invention, the impeller in a pump casing is adapted for reverse rotation to draw water by suction from a delivery outlet of the delivery casing, which discharges jets of pressurized water in a forward travel, and to discharge jets of pressurized water from the suction inlet of the suction casing, thus switching the suction inlet of water and the delivery outlet of pressurized water jets therebetween, enabling switch from forward travel to backward travel.

The impeller chamber of the suction casing and the delivery casing may preferably be formed circular cylindrical at inside diameters thereof to be substantially identical in size. This arrangement substantially equalizes respective amounts of water to be pressurized and swirled by forward rotation and reverse rotation of axial flow blades, allowing for a rapid switching between forward travel and backward travel of vessel.

A single stage of axial flow blades may preferably be disposed in the impeller chamber of the suction casing, and axial flow blades may preferably be configured as a counter-rotating double-impeller. In this arrangement, swirling streams of water pressurized by an axial flow type front impeller may be converted into straight streams by a rear impeller, to thereby convert energy of swirling streams into pressure exerting energy, with an increased impeller efficiency relative to the single stage impeller.

A forward-reverse rotation effecter may preferably be coupled for connection at a side wall of the suction casing in which the impeller chamber has a counter-rotating double-impeller disposed therein. This arrangement allows a drive shaft of the counter-rotating double-impeller to be short, and the front impeller and the rear impeller to have reduced vibrations. A forward-reverse rotation shifter may preferably be coupled for connection at a side wall of the suction casing in which the impeller chamber has a single stage of axial flow blades disposed therein, which allows the propulsion system to be compact.

The delivery casing may preferably have a bearing support fixed on an inner peripheral wall thereof for rotatably supporting a distal end of a drive shaft, the bearing support having thereon a plurality of ribs formed planer along an axis thereof so that swirling water streams pressurized by the set of axial flow blades are rectified by the bearing support, whereby the distal end of the drive shaft can be rotatably supported near axial flow blades, with reduced vibrations.

A deflector may preferably be disposed at a rear end of the delivery casing, having a helm fixed thereto, which allows the course holding performance to be improved in a turning travel, as well as the steering performance, with effective roll prevention, in addition to possible turning backward travel by the deflector to be turned left or right.

A pair of vessel propulsion systems may preferably be arranged at the vessel stern, allowing for the vessel to turn within a narrowed range, with possible transverse displacement and facilitated approach to and departure from a pier.

There may preferably be provided a vessel-side fronting branch path branched from the delivery casing having a rearward casing cooperative therewith for flow path selection therebetween, which allows a transverse propulsion.

BRIEF DESCRIPTION OF THE DRAWINGS

FIGS. 7A to 7D illustrate a vessel propulsion system according to still another embodiment of the invention, in which FIG. 7A is a plan view of this propulsion system, FIG. 7B is a side view of the propulsion system, FIG. 7C is a cross-sectional view of part VIIC of FIG. 7B, and FIG. 7D describes a flow path switching mechanism of the propulsion system.

PREFERRED EMBODIMENTS OF THE INVENTION

Figure 1:
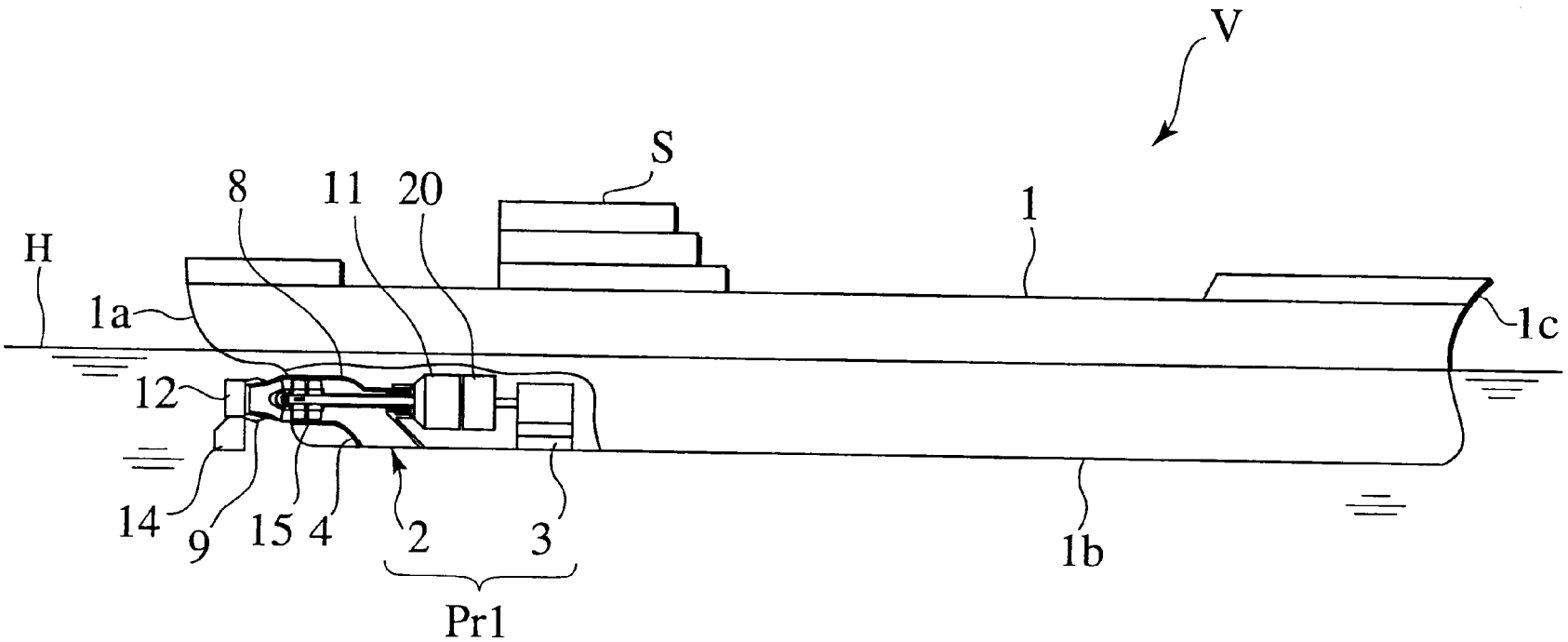
FIG. 1 is a partially cutaway side view of a vessel with a propulsion system according to an embodiment of the invention.

There will be detailed below preferred embodiments of the invention, with reference to the accompanying drawings. Like members or elements are designated by like reference characters.

Figure 2:
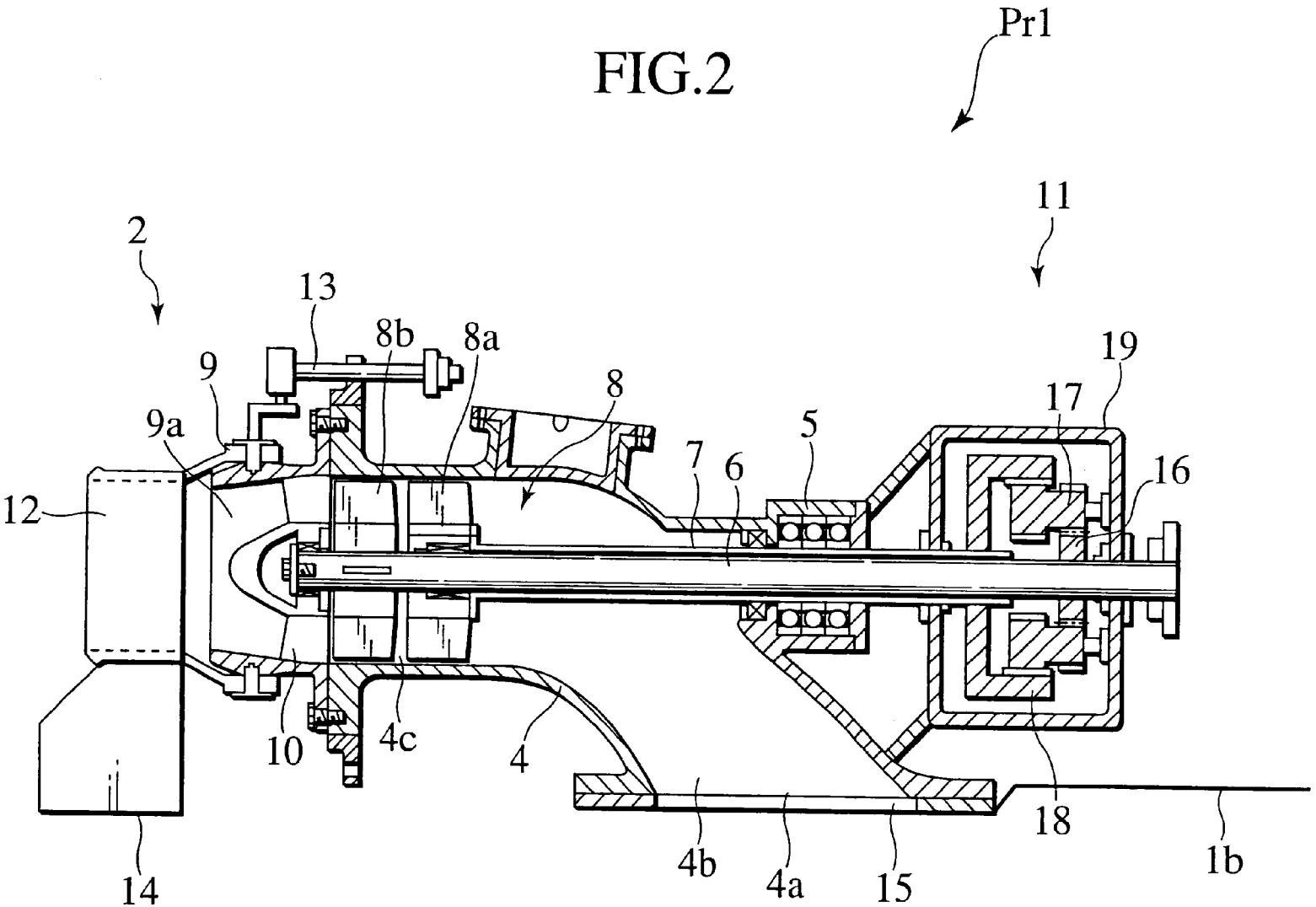
FIG. 2 is an elavational sectional view of a propulsion unit including a counter-rotating double-impeller of the propulsion system of FIG. 1.
Figure 3:
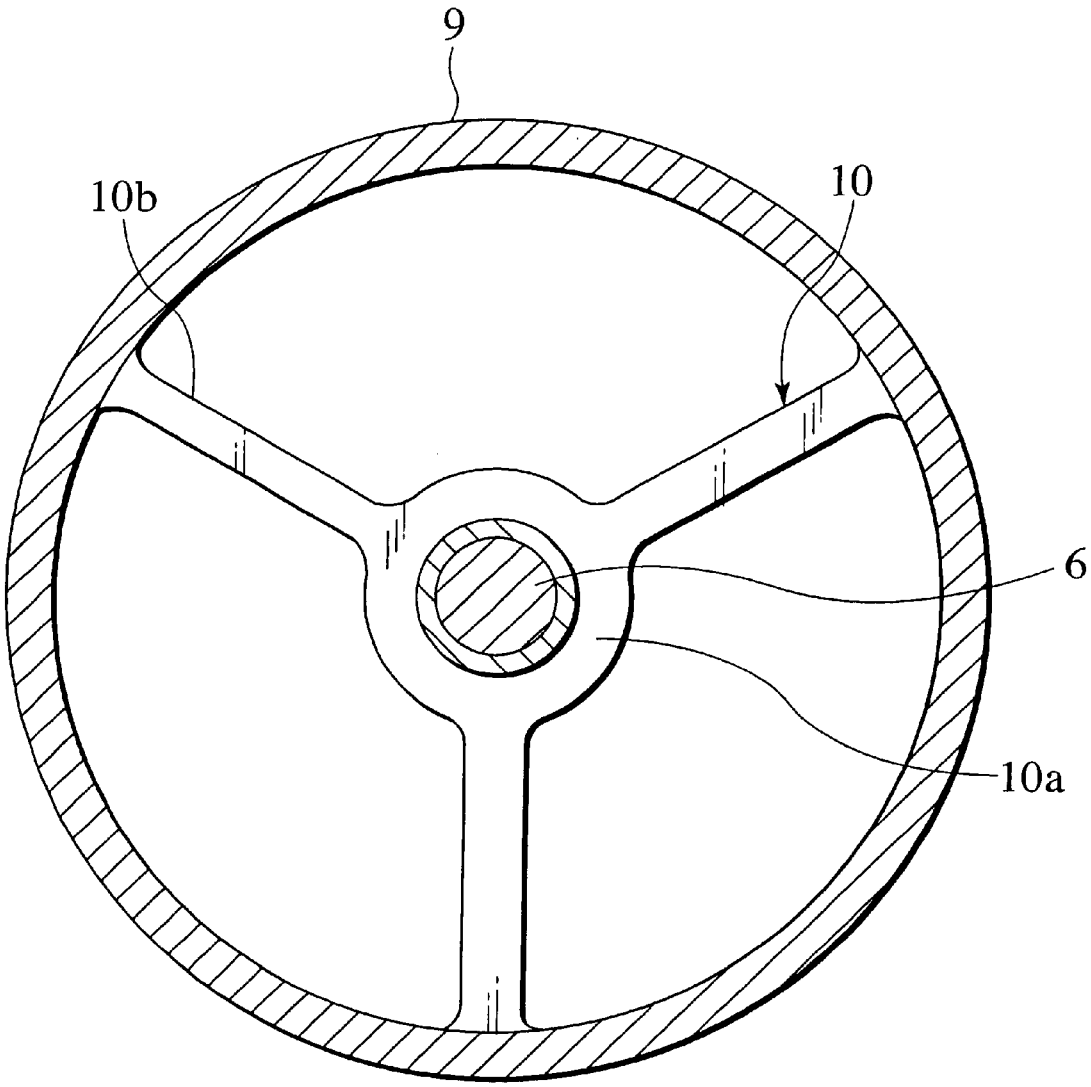
FIG. 3 is a front view of a bearing support provided in a delivery casing of the propulsion unit of FIG. 2.

Illustrated in FIG. 1 is a medium-scale vessel V with a propulsion system Pr1 according to a first embodiment of the invention, FIG. 2 is a propulsion unit 2 of the propulsion system Pr1, FIG. 3 is a bearing support 10 provided in a delivery casing 9 of the propulsion unit 2.

The vessel V is built with a hull 1 with a bottom 1*b* extending substantially straight from a bow 1*c* to a stern la, a multitiered structure S including a bridge, and fittings. The propulsion system Pr1 is installed in a rear lower region of the hull 1 and fastened to an upper surface of the bottom 1*b* and a lower part of the stern 1*a*. Reference character "H" designates the water surface as a draft of the hull 1.

This propulsion system Pr1 includes the water jet propulsion unit 2, an internal combustion engine 3 for driving the propulsion unit 2, and a forward-reverse rotation shifter 20 interposed between the internal combustion engine 3 and the propulsion unit 2.

The propulsion unit 2 has: a main drive shaft 6 connected at a front end thereof to the forward-reverse rotation shifter 20; a forward-reverse rotation effecter 11 as a planetrary-geared counter-rotating differential transmitter connected to the front end of the drive shaft 6; a hollowed subsidiary drive shaft 7 connected at a front end thereof to the forward-reverse rotation effecter 11 and held at a middle part thereof by a bearing 5, with the main drive shaft 6 coaxially penetrating therethrough; a counter-rotating double-impeller 8 with a spiral multiblade front impeller 8*a* keyed to a rear end of the subsidiary drive shaft 7 and a spiral multiblade rear impeller 8*b* keyed to the front end of the main drive shaft 6; a suction casing 4 as a long duct member with an inspection window, defining a suction inlet 4*a* opening at the bottom 1*b*, a suction flow path 4*b* ascending rearward, obliquely intersecting the suction inlet 4*a*, and a horizontal impeller chamber 4*c* circumscribed on the front and rear impellers 8*a* and 8*b* with minute clearances; and a delivery casing 9 configured as a short duct member defining a delivery flow path interconnecting the impeller chamber 4*c* and a water jet delivery outlet 9*a*, to be integral with a bearing support 10 implemented as a set of rectification plates for supporting the bearing at the front end of the main drive shaft 6.

A deflector 12 integrated with a helm 14 is pivoted to be transversely turnable on the rear end of the delivery casing 9, and steered with an operation lever member 13 controlled from the bridge. The suction inlet 4*a* has a screen 15 provided thereto for removal of foreign matters.

In the arrangement described, the propulsion unit 2 disposed at the bottom 1*b* of the stern 1*a* of the vessel V is apparently submerged under a surface level of the draft H (that is, the delivery outlet 9*a* is set in position with a top edge thereof under a draft mark for an unloaded condition). The propulsion unit 2 is driven by the internal combustion engine 3, pressurizing water drawn by suction from water under the vessel bottom 1*b*, discharging pressurized water jets into water behind the stern 1*a*, propelling the hull 1 to travel.

The bearing 5 is integrally provided on an outer peripheral wall of the suction flow path 4*b* of the suction casing 4. The drive shafts 6 and 7 rotatably supported by the bearing 5 penetrate a side wall of the suction casing 4, extending into the impeller chamber 4*c*.

The delivery casing 9 submerged under the draft of the stern 1*a* is coupled for connection to the rear end of the suction casing 4. The impeller chamber 4*c* of the suction casing 4 and the delivery casing 9 are formed circular-cylindrical with their fixing dimensions (inside diameters in this case) set substantially mutually identical to equalize respective amounts of swirling pressurized water in forward rotation and reverse rotation of the impeller 8, with a reduced power loss and an increased propelling force in comparison with the conventional arrangement in which water streams are reversed.

As shown in FIG. 3, the bearing support 10 is integrated with the delivery casing 9. The bearing support 10, which is fixed to an inner peripheral wall of the delivery casing 9, has in a central part thereof a boss 10*a* configured to rotatably support the rear end of the drive shaft 6 extended into the suction casing 4, that is, for a rotatable supporting of a distal end of the drive shaft 6 in a vicinity of the counter-rotating double-impeller 8 to reduce vibrations.

The bearing support 10 has a plurality of axially planar ribs 10*b*. Ribs 10*b* of the bearing support 10 are configured to rectify swirling streams of water pressurized by the counter-rotating double-impeller 8.

For the forward-reverse rotation effecter 11,*a* case 19 is integrally formed with a side wall of the suction casing 4. The hollow drive shaft 7, on which the front impeller 8*a* is fixed, and the drive shaft 6, on which the rear impeller 8*b* is fixed, are coupled for connection at proximal ends thereof to the forward-reverse rotation effecter 11, whereby the respective drive shafts 6 and 7 are possibly shortened, with reduced vibrations at the front and rear impellers 8*a* and 8*b*.

The deflector 12, provided at the rear end of the delivery outlet 9*a* of the delivery casing 9, is turned left and right by the operation lever member 13 for changing the delivery direction of water streams to change the azimuth of travelling course of hull 1.

The helm 14,fixed to a lower end of the deflector 12, enhances the course holding performance and steering performance of hull 1.

As shown in FIG. 2, the forward-reverse rotation effecter 11 on the side wall of the suction casing 4 has a sun gear 16 fixed on the proximal end of the drive shaft 6, a plurality of planet gears 17 meshing with the sun gear 16, and an internal gear 18 meshing as a ring gear with the planetary gears 17. The internal gear 18 is fixed on the proximal end of the hollow drive shaft 7.

The forward-reverse rotation effecter 11 is configured such that, as the sun gear 16 rotates, the internal gear 18 is reverse-rotated via the planet gears 17, causing the front and rear impellers 8*a* and 8*b* to rotate in opposite directions.

At the impeller chamber 4*c* of the suction casing 4, in flowing water is pressurized by the front impeller 8*a* into swirling streams, which are guided onto blade surfaces of the rear impeller 8*b*, exerting increased push-in pressures on the rear impeller 8*b*, which impeller 8*b* in turn converts resultant high-pressure swirling streams into straight streams, additionally exerting pressures thereon.

Accordingly, rotational power is energy-converted into pressures at the counter-rotating double-impeller 8, and high-pressure jets are delivered into water from the delivery outlet 9*a* of the delivery casing 9, whereby the hull 1 is propelled, while the deflector 12 with the helm 14 fixed thereto is turnable to change the course of hull 1.

It is noted that, in a full-speed travel, jets of pressurized water discharged behind the stern la may well appear above the water surface.

Figure 4:
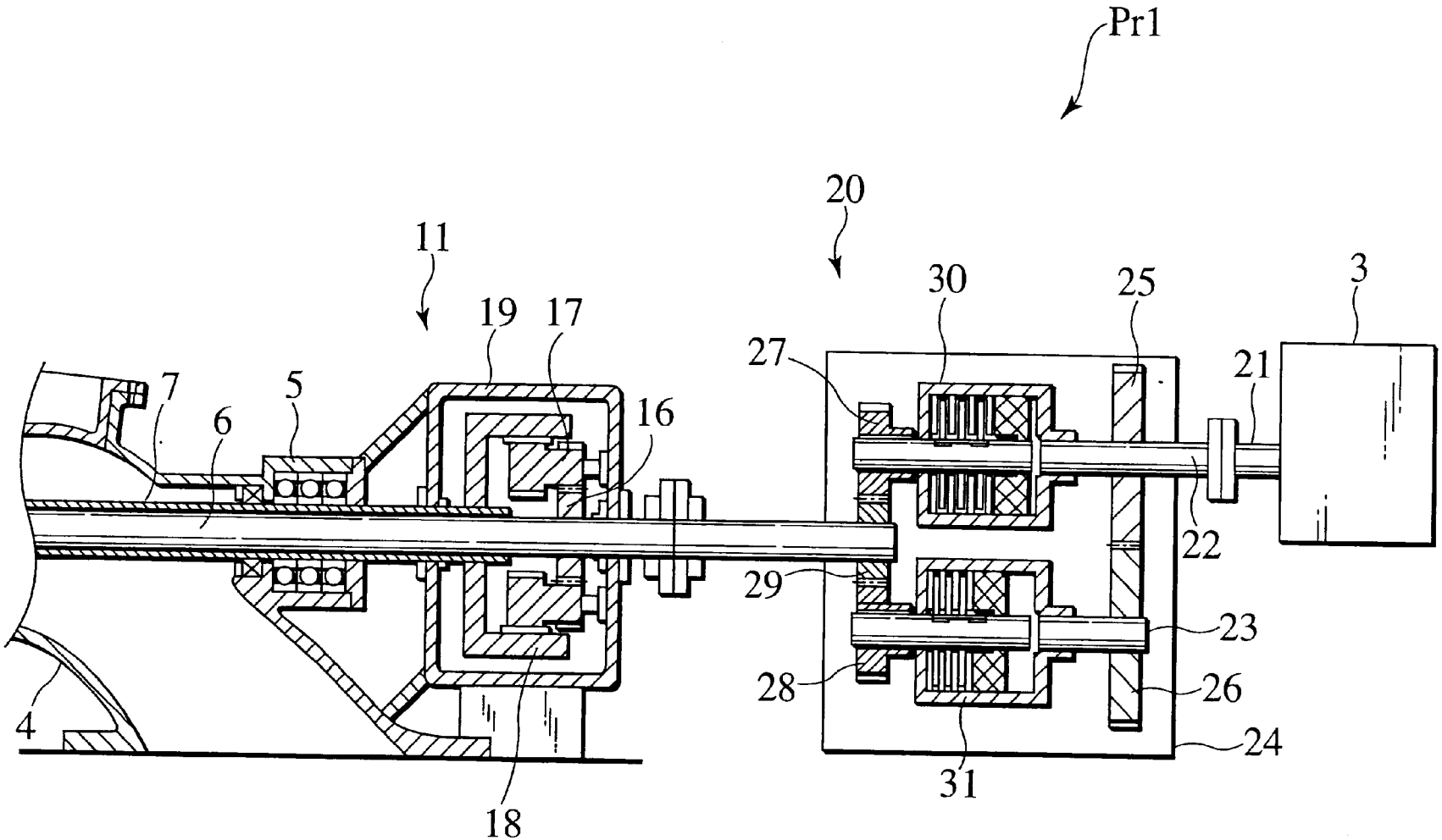
FIG. 4 is an elevational sectional view of a forward-reverse rotation shifter interposed between the propulsion unit of FIG. 2 and an internal combustion engine.

FIG. 4 illustrates a coupling condition among counter-rotating double-impeller 8, forward-reverse rotation effecter 11, and forward-reverse rotation shifter 20. The forward-reverse rotation effecter 11, provided on the side wall of the suction casing 4, is coupled for connection to the internal combustion engine 3, with the forward-reverse rotation shifter 20 connected therebetween. Thus, rotation of an output shaft 21 of the internal combustion engine 3 is transmitted via the forward-reverse rotation shifter 20, where the rotational direction is switched from forward to reverse, to the main drive shaft 6 to be thereby driven for rotation, which in turn is transmitted to the hollowed drive shaft 7 via the forward-reverse rotation effecter 11, where the rotational direction turns counter, thereby causing the front and rear impellers 8*a* and 8*b* of the counter-rotating double-impeller 8 to rotate in opposite directions.

The forward-reverse rotation shifter 20 has an input shaft 22 coupled with the output shaft 21 of the internal combustion engine 3, and an input-side idle shaft 23 rotatably supported on a gear case 24. A first gear 25 fixed on the input shaft 22 and a second gear 26 fixed on the idle shaft 23 mesh with each other, rotating in opposite directions.

An output shaft arranged coaxial with the input shaft 22, and an output-side idle shaft arranged coaxial with the input-side idle shaft 23 have at their distal ends a first transmission gear 27 and a second transmission gear 28 fixed thereon, respectively, which first and second transmission gears 27 and 28 mesh with a drive gear 29 fixed on the drive shaft 6, which is inserted into a gear case 24.

The input shaft 22 is connected to the output shaft via a forward-propulsion oriented hydraulic multi-disc clutch 30, as well as the input-side idle shaft 23 connected to the output-side idle shaft via a backward-propulsion oriented hydraulic multi-disc clutch 31. The clutches 30 and 31 are hydraulically controlled for engagement and disengagement to make the drive shaft 6 rotate forward or reverse.

As an output of the internal combustion engine 3 has a rotational direction switched reverse by the forward-reverse rotation shifter 20 to have the counter-rotating double-impeller 8 rotated reverse, water is drawn by suction from the delivery outlet 9*a* of the delivery casing 9 submerged at the bottom 1*b* of stern 1*a*, and is transmitted to a rear end region of the rear impeller 8*b*, where it is pressurized by the rear impeller 8*b*, and pressurized swirling streams are rectified by the front impeller 8*a*, so that jets of pressurized water are discharged at the suction inlet 4*a* of the suction casing 4 into water toward the bow, propelling the hull 1 backward.

The impeller chamber 4*c* of the suction casing 4 and the delivery casing 9 have their inside diameters substantially identical in size, in combination with the counter-rotating double-impeller 8 of axial flow blades, whereby respective amounts of swirling pressurized water at the counter-rotating double-impeller 8 in forward rotation and reverse rotation are substantially equalized, effecting a fast switching between forward and backward propulsion of hull 1.

If foreign matters are caught on the screen 15 at the suction inlet 4*a* of the suction casing 4,blocking the suction inlet 4*a*, then the counter-rotating double-impeller 8 can be reverse-rotated for discharging pressurized water streams from inside the suction casing 4 to wash off the foreign matters blocking the suction inlet 4*a*, outside the screen 15.

The deflector 12 can be turned left or right for the hull 1, guided in backward travel by the helm 14, to turn within a small turning range.

Figure 5:
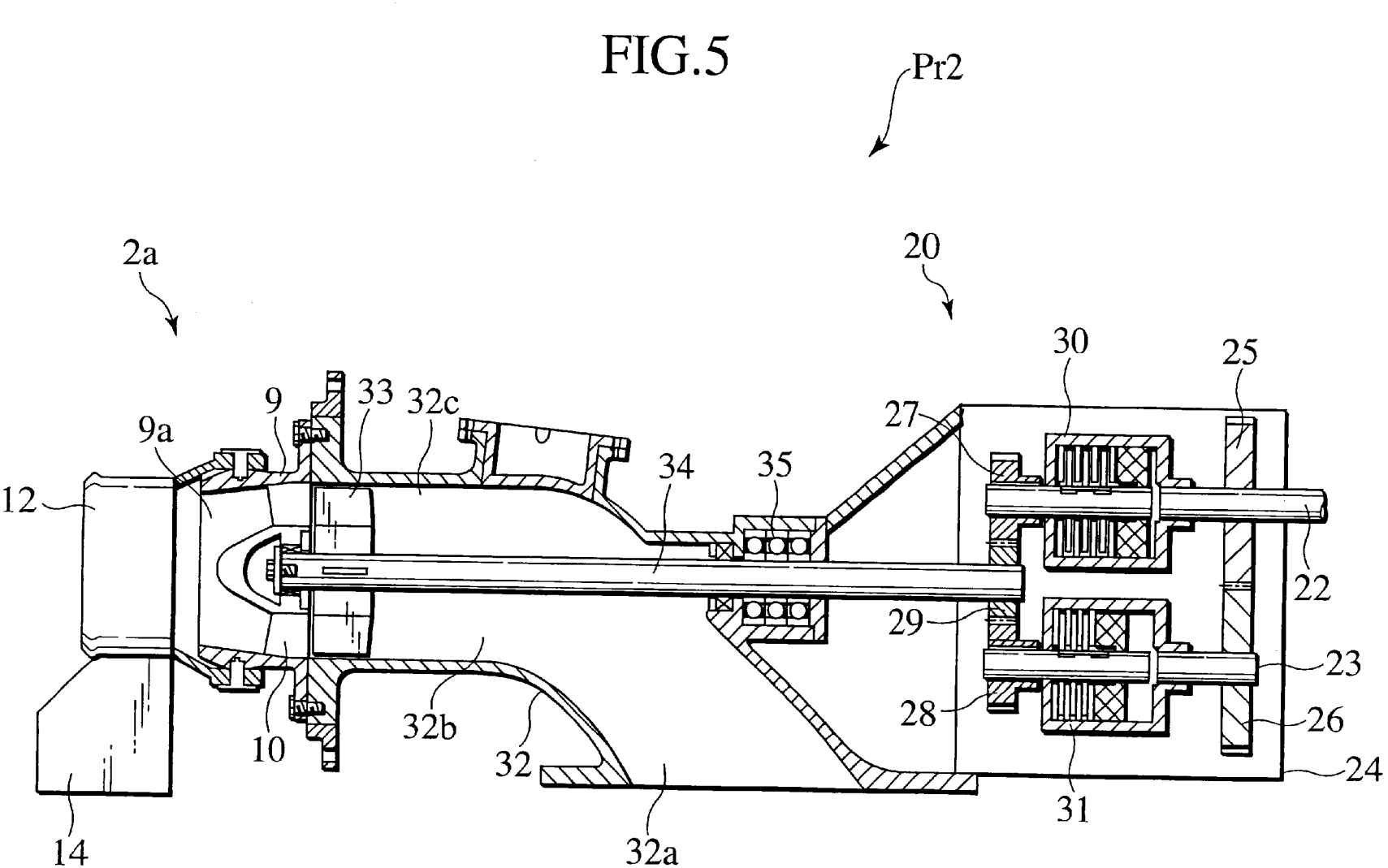
FIG. 5 is an elevational sectional view of a vessel propulsion system including a single-staged impeller and a forward-reverse rotation shifter of a multiple disc fashion according to another embodiment of the invention.

FIG. 5 illustrates a vessel propulsion system Pr2 according to another embodiment of the invention. A propulsion unit 2*a* of the propulsion system Pr2 has a single-stage impeller 33 provided in an impeller chamber 32*c* of a suction casing 32. A drive shaft 34 of the impeller 33 extends through a side wall of the suction casing 32, to be rotatably supported by a bearing 35 integrated to an outer peripheral wall of the suction casing 32. The drive shaft 34 is connected at the proximal end to a forward-reverse rotation shifter 20 integrated to a peripheral wall of the suction casing 32. The drive shaft 34, supporting the impeller 33, is thus shortened, with reduced vibrations at the impeller 33.

The impeller 33 is rotated forward to pressurize water drawn into the impeller chamber 32*c* by suction from a suction inlet 32*a* of the suction casing 32 with the impeller 33. Swirling pressurized water is rectified straight by planer ribs 10*b* of a bearing support 10. Rectified pressurized water is discharged as jets from a delivery outlet 9*a* of a delivery casing 9 into water, propelling the hull 1. A deflector 12 with a fixed helm 14 is turned rotated to change the course of hull 1.

In FIG. 5, when output of an internal combustion engine 3 is switched to a reverse rotation by the forward-reverse rotation shifter 20 to reverse the rotation of the impeller 33, water drawn from the delivery outlet 9*a* of the delivery casing 9 submerged at the bottom 1*b* of stern 1*a* is pressurized by the impeller 33 and discharged jets under high pressure from the suction inlet 32*a* of the suction casing 32 into water toward the bow, thereby propelling the hull 1 backward.

The propulsion unit 2*a*, provided with the single-stage impeller 33, is applicable to vessels not oriented for high-speed travel. The propulsion unit 2, provided with the counter-rotating double-impeller 8, is more efficient at the impeller chamber 4*c* than the single-stage impeller 33, and has an overall propulsion efficiency equal to or greater than the conventional impeller.

The propulsion unit 2 or 2*a* may be arranged together with another propulsion unit 2 or 2*a* in a counter-rotatable fashion, side by side with paralleled alignment centers at the stern 1*a* of hull 1. This arrangement discharges jets of pressurized water in opposite directions to allow turning and transverse displacement within a narrow range, facilitating getting to and leaving from a pier.

Figure 6:
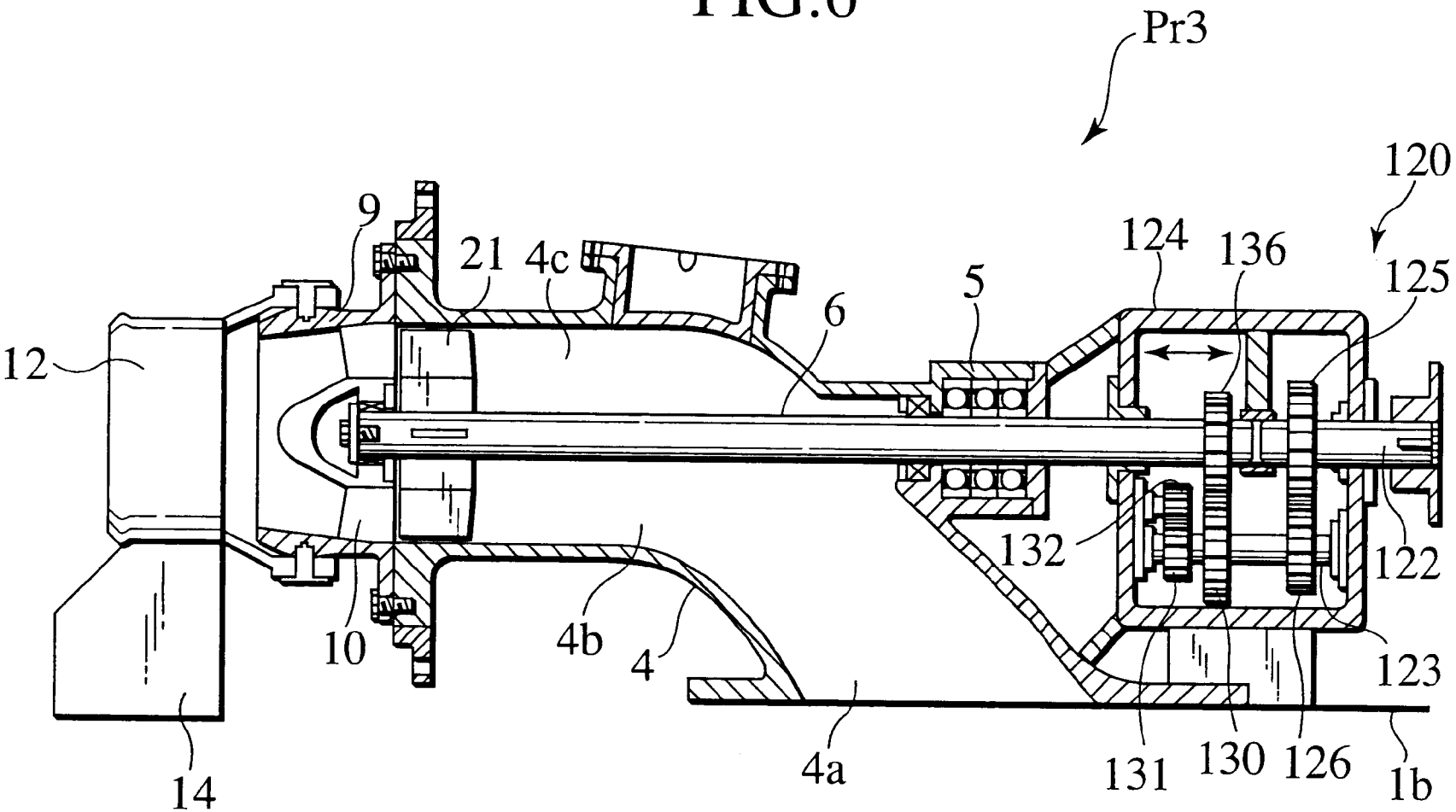
FIG. 6 is an elevational sectional view of a vessel propulsion system including a single-staged impeller and a geared forward-reverse rotation shifter according to another embodiment of the invention.

FIG. 6 illustrates a vessel propulsion system Pr3 according to still another embodiment of the invention. The propulsion system Pr3 is different from the embodiment Pr2 in that a gear forward-reverse rotation shifter 120 is used in place of the multiple disc clutch forward-reverse rotation shifter 20.

The forward-reverse rotation shifter 120 has an input shaft 122 coupled to an output shaft of an internal combustion engine and an idle shaft 123 rotatably supported on a gear case 124. A first gear 125 fixed on the rear end of the input shaft 122 and a second gear 126 fixed on the front end of the idle shaft 123 mesh with one another for counter rotation.

A transmission gear 130 for forward propulsion and a transmission gear 131 for backward propulsion are fixed on a rear part of the idle shaft 123. The transmission gear 131 for backward propulsion is further meshed with another idle gear 132. The proximal part of-the drive shaft 6 is inserted through the gear case 124. A transmission gear 136 is axially slidably fitted onto the end of the proximal part of the drive shaft 6.

The axial position of the transmission gear 136 is switched with a clutch not shown. The transmission gear 136 is meshed with the transmission gear 130 for forward propulsion for forward travel and is meshed with the idle gear 132 for backward travel.

Figures 7A, 7B, 7C, 7D:
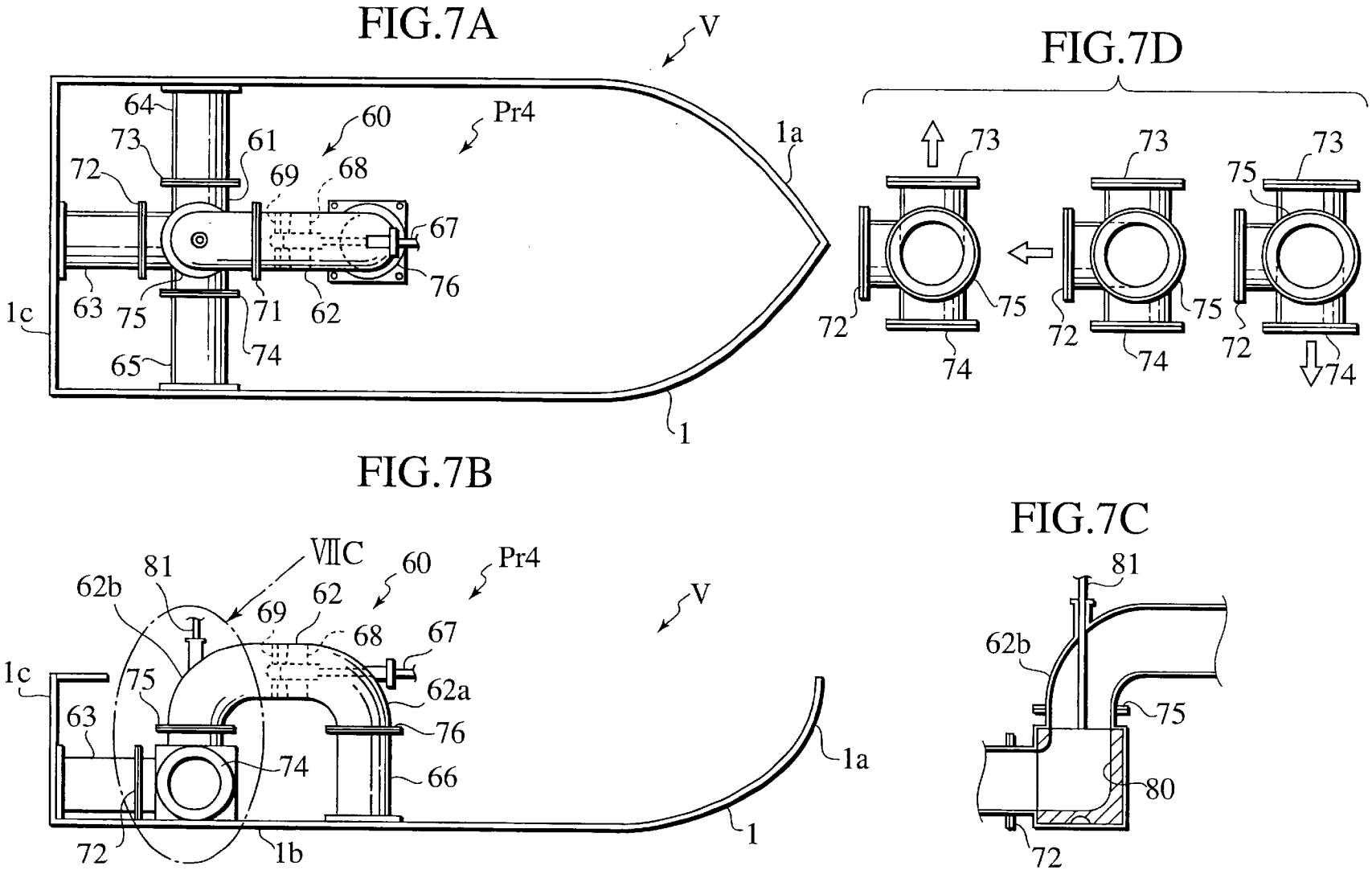

FIGS. 7A to 7D illustrate a vessel propulsion system Pr4 according to still another embodiment of the invention. FIG. 7A is a plan view of the propulsion system Pr4. FIG. 7B is a side view of the propulsion system Pr4. FIG. 7C is a cross-sectional view of a part pointed by arrow VIIC in FIG. 7B. FIG. 7D is an explanatory view of a flow path switching mechanism in the propulsion system Pr4.

A propulsion unit 60 of the propulsion system Pr4 has a U-shaped impeller casing 62 with a function and structure similar to those of the propulsion unit 2 shown in FIG. 2, a front casing 66 and a three-branch casing 61 respectively connected to the front end 62*a* and rear end 62*b* of the casing 62 via flanges 76 and 75, and a rear casing 63, left casing 64 and right casing 65 respectively connected to the three-branch casing 61 via flanges 72, 73 and 74, being substantially horizontally opening into the water from a stern 1*c* and left and right sides of the hull 1.

These rear, left and right casings 63, 64 and 65 have delivery outlets fixed with flanges to the hull 1, and are provided with a plurality of horizontal straightening vanes, respectively.

The structure of the delivery outlet of the front casing 66 is the same as in the above-described propulsion unit 2. A drive shaft 67 for driving a single-stage impeller 68 or counter-rotating double-impellers 68+69 is connected to an internal combustion engine with the same structure as in the above-described propulsion system Pr1.

As shown in FIG. 7A, the impeller casing 62 may be divided at a middle part thereof and connected with flanges 71 to facilitate inspection and maintenance.

The three-branch casing 61 incorporates, as shown in FIG. 7C, a flow path selection valve 80 operated via an external operating rod 81. As shown in FIG. 7D, the selection valve 80 allows the switching of a flow path to the left, rear and right, thereby to propel the vessel V rightward, forward and leftward.

The casing structure of the embodiment Pr4 may be applied to the other embodiments.

Figure 8:
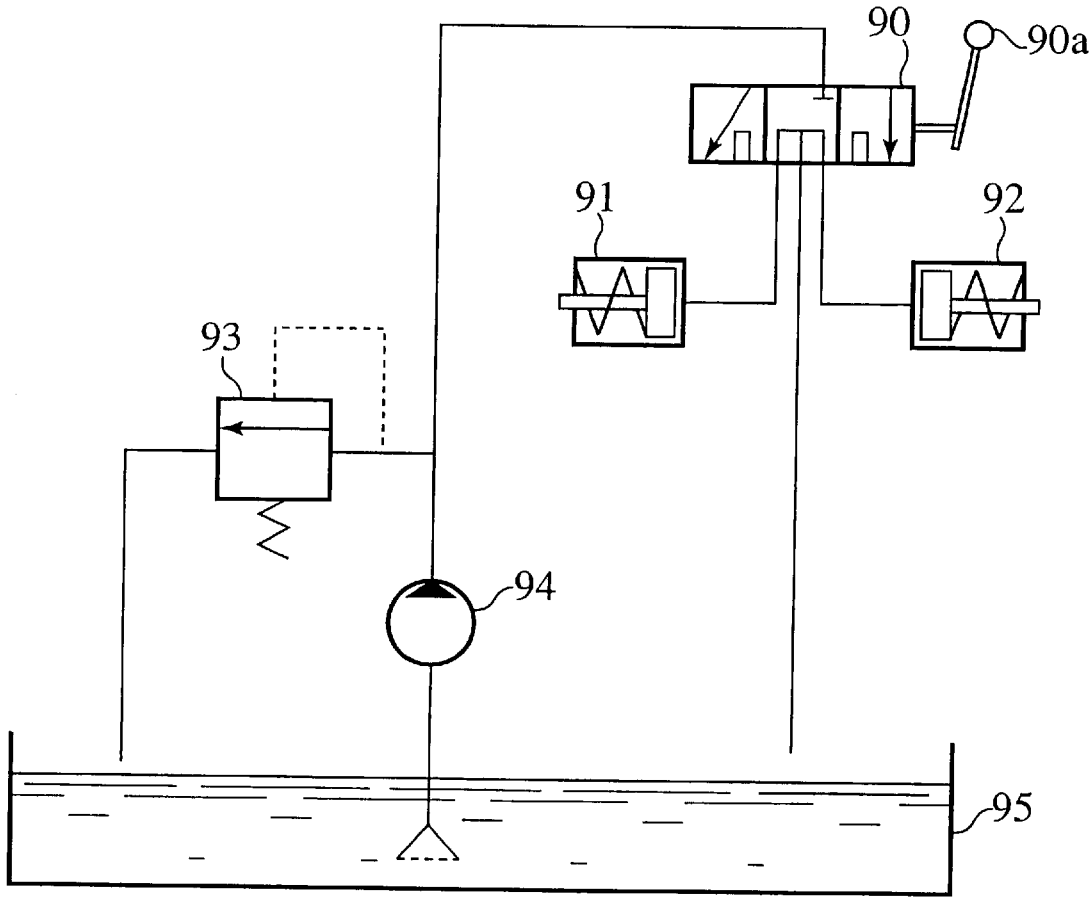
FIG. 8 is a hydraulic circuit diagram of a forward-backward travel switching mechanism.

FIG. 8 illustrates a hydraulic circuit of a forward-backward propulsion switching clutch applicable to each embodiment.

With this hydraulic circuit, the operation of a switching valve 90 with a switching lever 90*a* switches hydraulic pressure between a forward propulsion clutch 91 and a backward propulsion clutch 92 connected to a related operating part of a forward-backward propulsion switching mechanism. In the figure, reference numeral 93 denotes a relief valve, 94 a hydraulic pump, and 95 an oil tank.

As will be apparent from the above description, the invention rotates an impeller provided in an impeller chamber of a suction casing to draw water from a suction inlet of the suction casing at the bottom of the hull, and pressurizes water moving upward in an inlet path with the impeller.

The pressurized swirling water is straightened with plate-like ribs of a bearing support to convert rotational power into pressure power.

Flux of water jets is discharged from a delivery outlet of a delivery casing into the water in the stern direction to propel the vessel. A deflector provided at the rear end of the delivery casing is rotated to change the propelling direction for traveling.

When a counter-rotating double-impeller is provided in the impeller casing, swirling water pressurized by a front impeller is guided to the blade surfaces of a rear impeller to increase forcing pressure into the rear impeller.

The rear impeller converts the pressurized swirling water flow into a straightened flow while further pressurizing the water, increasing the propelling power of the vessel.

To propel the vessel backward, the impeller is rotated in the reverse direction to draw water from the delivery outlet of the delivery casing submerged. The water pressurized by the impeller is discharged as jets from the suction inlet of the suction casing into the water in the bow direction to switch from forward travel into backward travel, thereby to propel the vessel backward.

The amounts of swirling pressurized water during the forward rotation and the reverse rotation of the impeller are substantially equal to one another. This facilitates the switching between forward travel and backward travel of the vessel.

The rotation of the deflector left and right enables backward turning with a helm provided to the deflector.

A vessel having propulsion units arranged along two parallel axes in the stern can turn in a narrow place with one of the propulsion units near the turning direction reversed in rotation, and also can shift laterally. The use of the helm facilitates the leaving and getting to shore of a vessel of a large size with the vessel propulsion system enabling small backward turning.

When foreign matters are caught on a screen provided at the suction inlet of the suction casing and blocks the inlet during the forward travel of the vessel, the reverse rotation of the impeller can pressurize water drawn from the delivery casing with the impeller to discharge pressurized water as jets from the suction flow path of the suction casing toward the rear surface of the screen, washing off the foreign matters blocking the inlet from the screen.

The provision of branching paths branched from a rear casing and opening at sides of the hull so as to enable selection of a flow path among the branching paths and the rear casing, enables propulsion in a lateral direction.

INDUSTRIAL APPLICABILITY

The invention provides a water jet vessel propulsion system with a small loss of power due to forward-backward propulsion switching, allowing leaving and getting to shore in a narrow range.

I claim:

1. A vessel propulsion system, comprising:

a suction casing configured with a suction inlet opening at a bottom of a hull of a vessel, a suction flow path ascending from the suction inlet, and an impeller chamber substantially horizontal in position, and disposed at a bottom part of a stem of the hull;

a delivery casing connected to the suction casing and submerged under a draft of the hull;

a combination of front and rear impellers provided inside the impeller chamber of the suction casing;

a combination of first and second drive shafts provided through the impeller chamber of the suction casing for driving the front and rear impellers to rotate, respectively;

a counter rotating gearset provided outside the impeller chamber of the suction casing for rotating the first drive shaft in a counter direction to a rotating direction of the second drive shaft; and a forward-reverse rotation shifter provided outside the impeller chamber of the suction casing for shifting the rotating direction of the second drive shaft between a forward direction and reverse direction.

2. The vessel propulsion system as set forth in claim 1, wherein the impeller chamber of the suction casing and the delivery casing are formed circular cylindrical at inside diameters thereof to be substantially identical in size.

3. The vessel propulsion system as set forth in claim 1, wherein the combination of front and rear impellers comprises a pair of front and rear sets of axial flow blades.

4. The vessel propulsion system as set forth in claim 3, wherein the counter rotating gearset is mounted to a side wall of the suction casing.

5. The vessel propulsion system as set forth in claim 1, wherein:

the delivery casing has a bearing support fixed to an inner peripheral wall thereof for rotatably supporting a distal end of the second drive shaft; and the bearing support has a plurality of ribs formed planar along an axis thereof for rectifying swirling streams of water pressurized by the combination of front and rear impellers.

6. The vessel propulsion system as set forth in claim 1, wherein a deflector is disposed at a rear end of the delivery casing, and has a helm fixed thereto.

7. The vessel propulsion system as set forth in claim 1, further comprising a vessel-side fronting branch path branched from the delivery casing having a rearward casing cooperative therewith for flow path selection therebetween.

8. The vessel propulsion system as set forth in claim 1, wherein the suction casing comprises a front casing defining the suction flow path, and a substantially U-shaped impeller casing defining the impeller chamber.

* * * * *